US005497132A

United States Patent [19]

Mader

[11] Patent Number: 5,497,132

[45] Date of Patent: Mar. 5, 1996

[54] RELAY

[75] Inventor: Leopold Mader, Mödling, Austria

[73] Assignee: EH-Schrack Components Aktiengesellschaft, Vienna, Austria

[21] Appl. No.: 269,007

[22] Filed: Jun. 30, 1994

[30] Foreign Application Priority Data

Jul. 2, 1993 [AT] Austria ..... 1310/93

[51] Int. Cl.[6] ..... H01H 51/22

[52] U.S. Cl. ..... 335/78; 335/83

[58] Field of Search ..... 335/78–86, 128, 335/133, 124

[56] References Cited

U.S. PATENT DOCUMENTS 4,958,137 9/1990 Schroeder ..... 335/128

5,083,104 1/1992 Bassino ..... 335/128

5,396,204 5/1995 Matsuoka et al. ..... 335/78

*Primary Examiner*—Lincoln Donovan

*Attorney, Agent, or Firm*—Henry M. Feiereisen

[57] ABSTRACT

Relay having a coil, a magnetic system and a contact system which is actuatable by the magnetic system via a comb made of an electrically insulating material and includes at least one essentially fixed contact and a contact controlled by the magnetic system. In order to realize the prestress of the essentially fixed contact (3), the resilient holder (21) is secured on an essentially rigid contact carrier (3'), with the resilient holder (21) being prestressed against the contact carrier (3') via a stopper which is bent outwards therefrom and supports the resilient holder.

3 Claims, 3 Drawing Sheets

RELAY

BACKGROUND OF THE INVENTION

The invention refers to a relay of a type a coil, a magnetic system and a contact system which actuatable via a comb made of an electrically insulating material and includes at least one essentially fixed contact and a contact controlled by the magnetic system.

SUMMARY OF THE INVENTION

It is an object of the present invention to provide an improved relay.

This object is attained in accordance with the present invention by providing an essentially fixed contact (3) arranged upon a resilient holder (21), with the resilient holder (21) being retained on an essentially rigid contact carrier (3'), wherein the resilient holder (21) is prestressed against the contact carrier (3') by a stopper which is bent outwards from this contact carrier (3') and supports the resilient holder (21), and wherein optionally the movable contact (23) is arranged on a U-shaped contact spring (12) which is mounted to an essentially rigid contact carrier (12').

Through the arrangement of the essentially fixed contact on a resilient holder, the follow of the contact may fluctuate within wide bounds.

The stopper enables a very simple modification of the prestress of the resilient holder by a more or less strong outward bending thereof.

This arrangement results in an automatic adjustment of the prestress force of the resilient holder relative to the pertaining contact carrier at preset stopper.

In accordance with another feature of the present invention, the moving contact is arranged on an U-shaped contact spring which is mounted on an essentially rigid contact carrier. These features allow a very simple adjustment of the moving contact.

BRIEF DESCRIPTION OF THE DRAWING

The invention will now be described in more detail with reference to the drawing, in which.

DETAILED DESCRIPTION OF A PREFERRED EMBODIMENT

Figure 1:
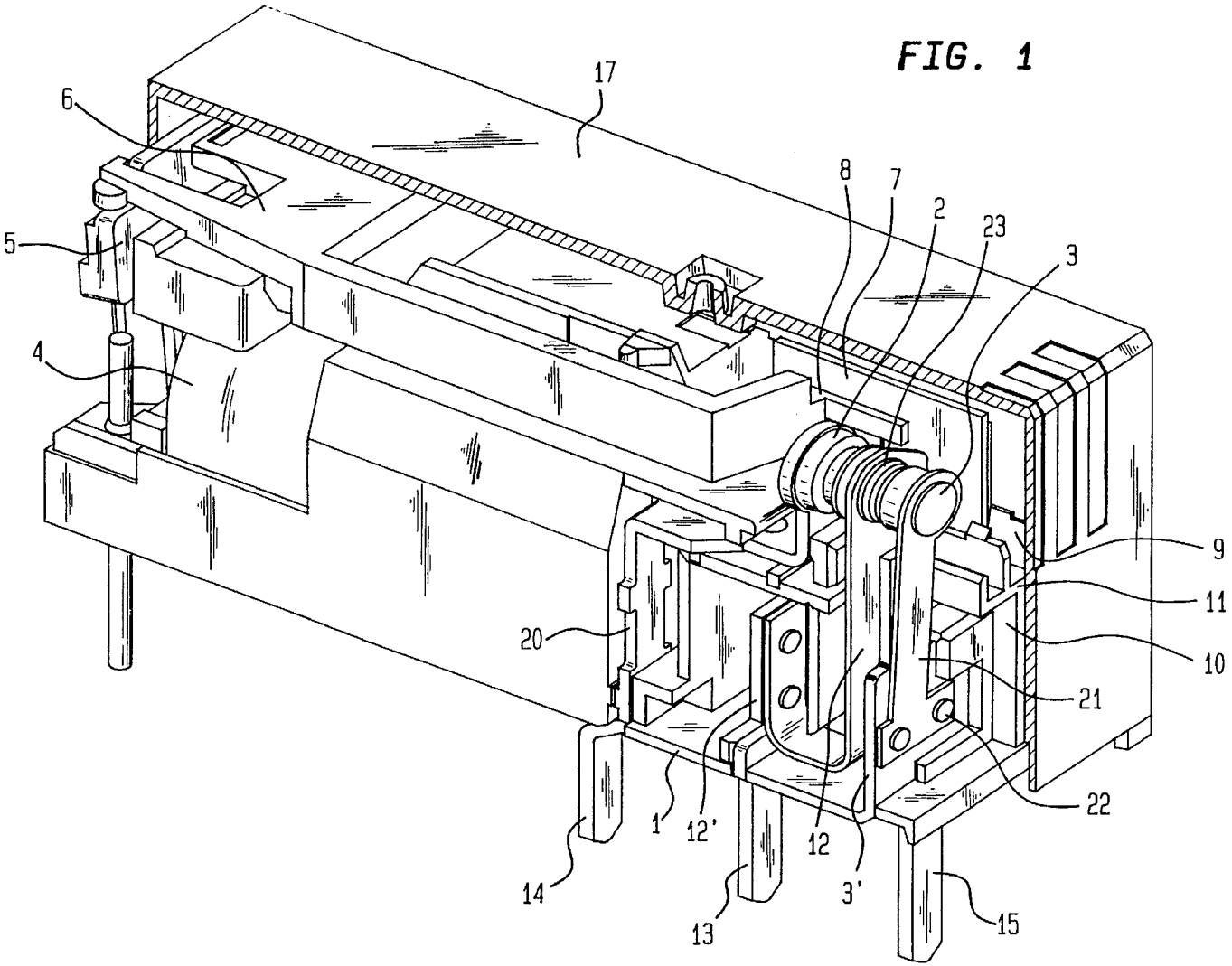
FIG. 1 is a schematic illustration of a relay according to the invention, with the casing cover being partially broken away.

The relay includes a base member 1 which incorporates the fixed contacts 2 and 3 and the contact carrier 3', respectively, with the contact system including two pole paths of which only one is illustrated in FIG. 1.

Further retained in the base member is a coil 4 which receives a magnetic system, with an armature 5 engaging in a comb 6 which rests on the top of the receptacle of the coil

4 and is slidable thereon. The comb 6 is of essentially lyra-shaped configuration and holds a lug 7 between projections 8. This lug 7 is guided in a groove 9 which is formed in a web 10 of the base member 1 between the pole paths, with the groove 9 being arranged in a headpiece 11 of the web 10.

The projections 8 of the comb 6 serve simultaneously as engaging member for the moving contact spring 12 which carries the moving contacts 23. This contact spring 12 is essentially of U-shaped configuration and is mounted on a contact carrier 12' which also includes a terminal lug 13. The fixed contact 21 is also provided with a terminal lug 14 as is the contact carrier 3' which includes a terminal lug 15, with the terminal lugs traversing the base member 1, and with a resilient holder 21 being secured by rivets 22 to the contact carrier 3' and holding the fixed contact 3 therein.

Figure 3:
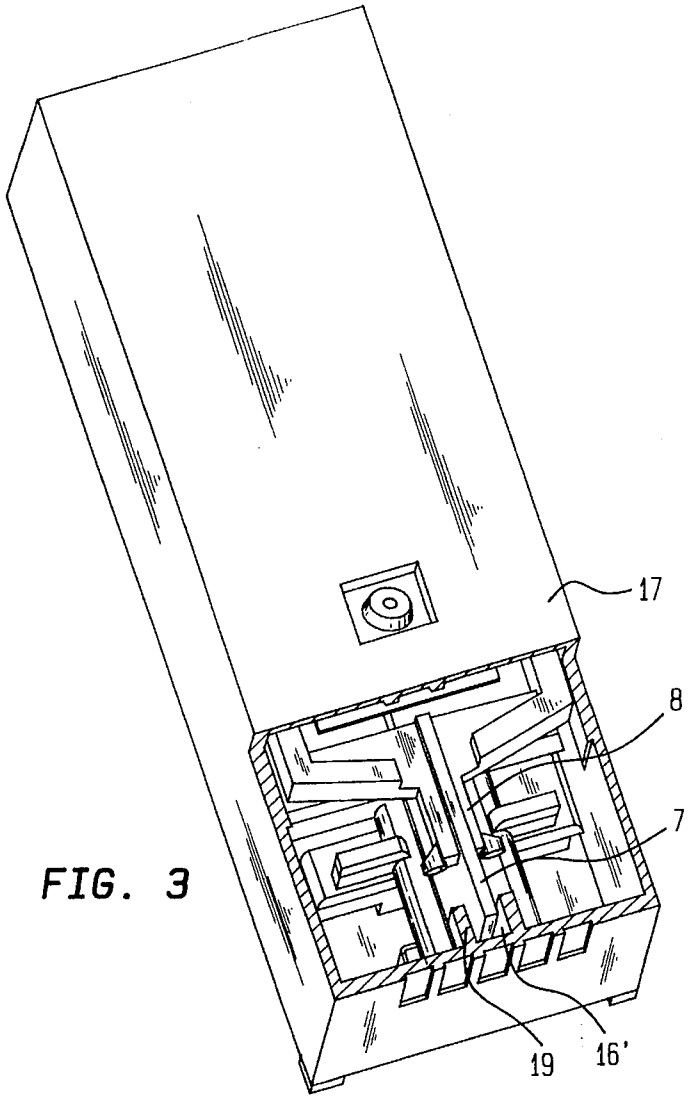
FIG. 3 shows the relay according to FIG. 1, with the top side of the casing cover being partly broken away and with the contact system being omitted.
Figure 2:
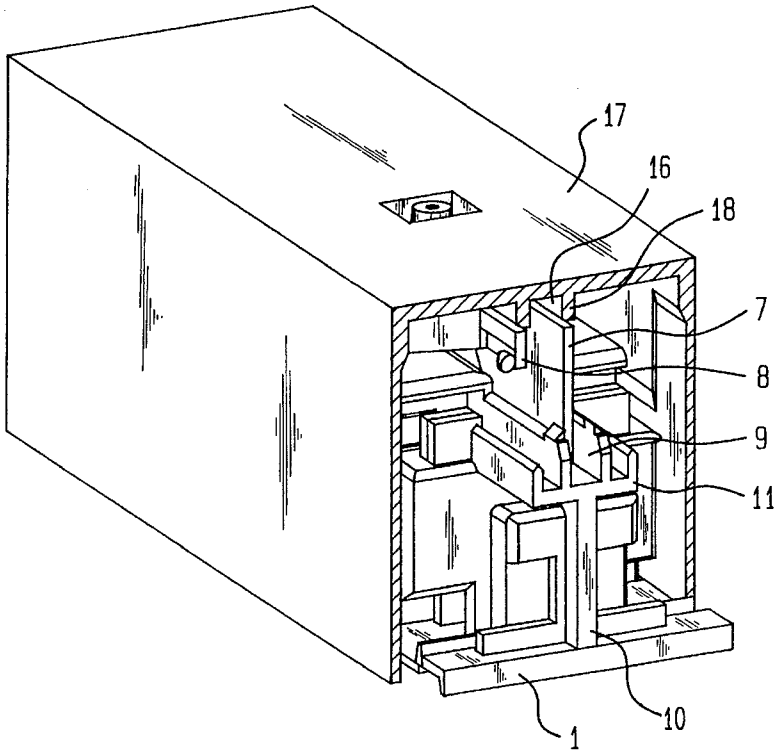
FIG. 2 shows the relay according to FIG. 1 with the front wall of the casing cover being broken away and with the contact system being omitted.

As shown in FIG. 3, the lug 7 is also guided in a groove 16 of a cover 17 which groove is formed in an inwardly projecting plate 18.

The lug which like the comb 6 is made of an electrically insulating material separates together with the web 9 and the plate 18 of the cover 17 both pole paths of the contact system, of which only one 2, 3, 12 is illustrated.

Figure 4:
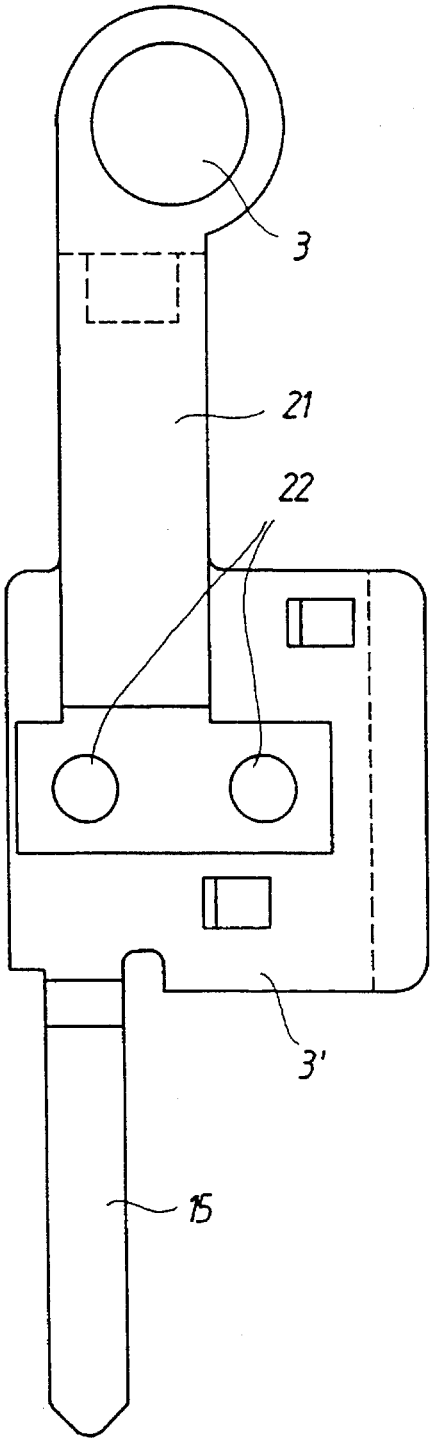
FIGS. 4 and 5 show end view and side view of a fixed contact arrangement.
Figure 5:
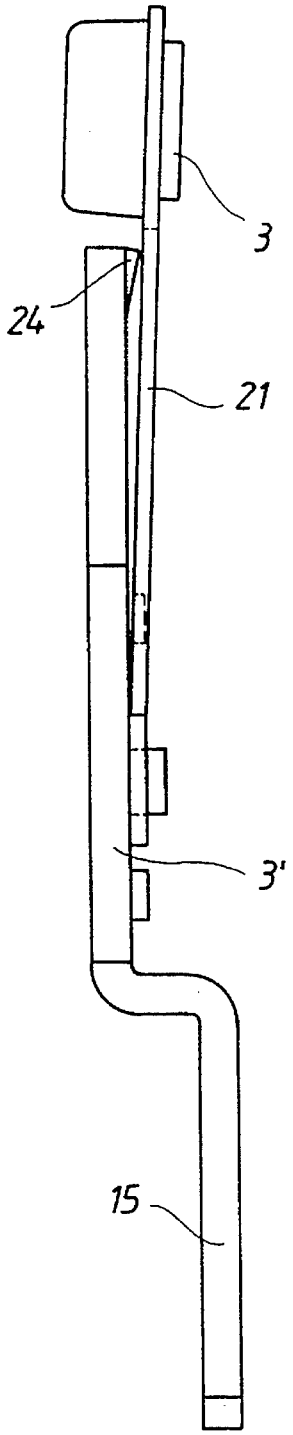

As shown in FIGS. 4 and 5, the resilient holder 21 is preferably of T-shaped configuration and is connected in the area of its crossbar by the rivets 22 with the contact carrier 3', with the resilient holder 21 being prestressed against the contact carrier. Bent outwards in the upper area of the contact carrier 3' is a stopper 24 which allows a simple adjustment of the prestress of the fixed contact 3. As shown in FIG. 1, the resilient holder 21 is arranged on the one side of the contact carrier 3' which faces away from the second fixed contact 2.

The arrangement of the one fixed contact 3 on a resilient holder 21 and of the stopper 24 on the contact carrier 3' thereon, as well as the U-shaped configuration of the contact spring 12 which supports the moving contacts 23, allows the adjustment of the relay solely on the resilient parts.

I claim:

1. A relay having a coil, a magnetic system and a contact system which is actuatable via a comb made of an electrically insulating material and includes at least one essentially fixed contact and a movable contact controlled by the magnetic system, wherein the essentially fixed contact (3) is arranged on a resilient holder (21), with the resilient holder (21) being secured on an essentially rigid contact carrier (3') wherein the resilient holder (21) is prestressed against the contact carrier (3') by a stopper which is bent outwardly from this contact carrier (3') and supports the resilient holder.

2. Relay according to claim 1 in which the contact system includes two essentially fixed contacts and a movable contact arranged therebetween, wherein in addition to the fixed contact (3) arranged on the resilient holder (21), a fixed contact (2) is provided and secured on an essentially rigid contact carrier (20), with the resilient holder (21) being held on the side of the pertaining contact carrier (3') facing away from the second fixed contact (2).

3. Relay according to claim 1, wherein movable contact (23) is arranged on an U-shaped contact spring (12) which is mounted on an essentially rigid contact carrier (12').

* * * * *